United States Patent [19]

Tuppini

[11] Patent Number: 4,928,504

[45] Date of Patent: May 29, 1990

[54] ARTICULATED BRACELET WITH COMPOSITE ELEMENTS

[75] Inventor: Remigio Tuppini, Verona, Italy

[73] Assignee: Tuppini Bigiotterie S.r.l., Verona, Italy

[21] Appl. No.: 284,705

[22] Filed: Dec. 15, 1988

[30] Foreign Application Priority Data

Dec. 17, 1987 [IT] Italy ..... 23063 A/87

[51] Int. Cl.[5] ..... A44C 5/00

[52] U.S. Cl. ..... 63/9; 63/4; 59/82

[58] Field of Search ..... 63/9, 3, 47; 59/80, 59/81, 82

[56] References Cited

FOREIGN PATENT DOCUMENTS

| | | | |
|---|---|---|---|
| 200871 | 11/1986 | European Pat. Off. | 59/82 |
| 2287869 | 5/1976 | France | 59/80 |
| 0089421 | 3/1982 | France . | |
| 2561879 | 10/1985 | France | 59/82 |
| 248574 | 5/1947 | Switzerland | 63/4 |
| 467597 | 3/1969 | Switzerland . | |
| 533967 | 4/1973 | Switzerland . | |
| 646851 | 12/1984 | Switzerland | 59/82 |
| 647661 | 2/1985 | Switzerland | 63/3 |
| 652578 | 11/1985 | Switzerland | 59/82 |
| 659571 | 2/1987 | Switzerland . | |
| 2170990 | 8/1986 | United Kingdom . | |

*Primary Examiner*—Laurie K. Cranmer

*Attorney, Agent, or Firm*—Charles E. Brown; Charles A. Brown

[57] ABSTRACT

An articulated bracelet with elements arranged relatively to one another in such a way as to form a chain, wherein the individual elements constituting each link of the bracelet are composed by unitary elements positioned side-by-side to one another in the transversal direction relatively to the bracelet, and are maintained associated with one another by a pin element also positioned transversely to the bracelet, and inserted inside a through-bore provided inside the same unitary elements. Furthermore in the nearby of the opposite free side faces of the unitary elements seats are provided, which are suitable for housing further pin-shaped linking element linking a bracelet link to the subsequent one.

7 Claims, 2 Drawing Sheets

ARTICULATED BRACELET WITH COMPOSITE ELEMENTS

The present invention relates to an articulated bracelet with composite elements.

It is known to provide articulated bracelets or straps, in particular for goldsmithery and watches, wherein the individual elements which constitute the successive transversal link elements are made enbloc, in such a way that, should they show a relatively simple surface decoration, one single mould is provided, in order to reduce the costs. The same takes place, if such a link element does not have a shape with flat side walls. This causes a considerable limitation in decorations and in their shapes, precisely due to the considerable cost of the moulds.

Bracelets with link elements with a complex pattern or decoration are anyawy also obtained by hand, with very long times, and consequently considerable costs, and have necessarily to be manufactured by not easily found specialized staff.

In case, then, the materials used are particularly hard, such as, e.g., stainless steel, a manual processing cannot be performed, and the limitation as regards the decoration results still more evident, by being subordinated to the manufacturing of suitable moulds.

The purpose of the present invention is to provide an articulated bracelet composed by chain elements, whose elements may constitute a pattern, or a decoration, of a whatever type, without special moulds having to be accomplished, and without the need of complex and expensive manual processing of links or link elements, in case the decoration is particularly complex.

These purposes according to the present invention are achieved by providing an articulated bracelet with composite elements arranged relatively to one another in a chain arrangement, in order to constitute a set of links, characterized in that individual composite elements, which constitute each one of said set of links of the bracelet, comprise unitary elements, transversely located side-by-side to one another and longitudinally associated with one another, wherein said unitary elements are retained in the transversal direction relatively to the bracelet by a pin element, also transversely positioned and inserted inside relevant bores provided in the above-said unitary elements, and that said individual elements constituted by said unitary elements are associated in the nearby of their free and opposite side faces, positioned in the transversal direction relatively to said bracelet, by means of further pin elements, which also are transversely positioned, and are inserted inside relevant complementary seats parallel to said side faces of said unitary elements, so as to provide the articulation between a brecelet link and the subsequent bracelet link.

The structural and functional characteristics and the advantages of an articulated bracelet according to the present invention are better understood from the following exemplifying and non-limitative disclosure, referred to the hereto attached schematic drawings, wherein.

Figure 1:
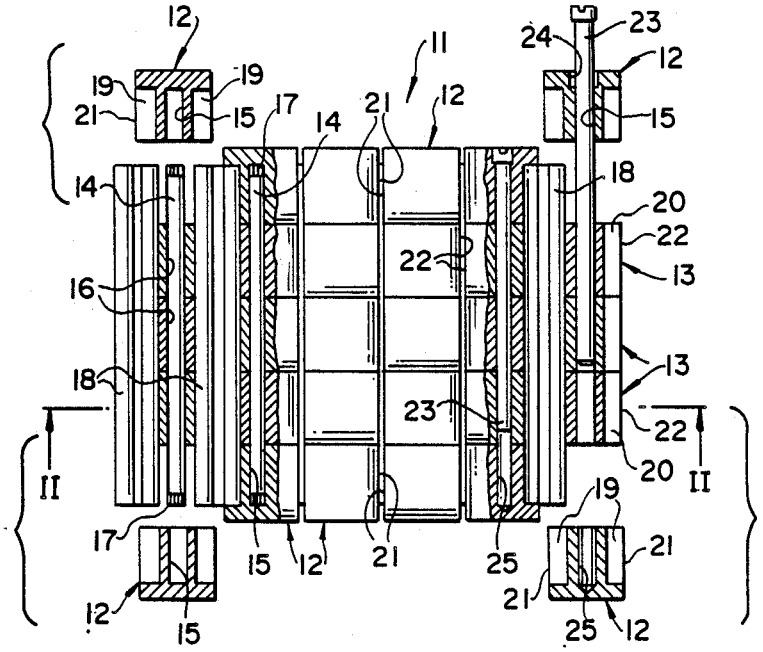
FIG. 1 shows a partially sectional and partially exploded plan view of a portion of a bracelet according to the invention.
Figure 2:
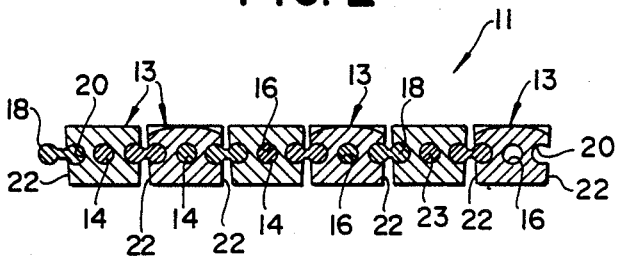
FIG. 2 shows a sectional view according to path II—II of FIG. 1.

Referring to FIGS. 1 and 2, an articulated bracelet according to the present invention, partially shown, is indicated by the reference numeral 11, and is constituted by a set of composite elements arranged relatively to one another in such a way as to form a chain, and each comprising unitary elements, i.e., end unitary elements, indicated by the reference numeral 12, and intermediate unitary elements, indicated by the reference numeral 13, to constitute a plurality of links.

The individual unitary elements 12, 13, constituting the composite element, and of prismatic shape, equal to one another, are positioned side-to-side, essentially transversely to one another, and are retained, still in the transversal direction relatively to the bracelet 11, by a pin element 14 inserted inside relevant blind bores 15 and through-bores 16, provided, lined-up to one another, inside each of said unitary elements 12, 13.

Preferably, said pin element 14 is provided with knurled end portions 17, capable of entering and being locked inside blind bores 15 of said unitary end elements 12, so as to maintain the individual unitary elements 12 and 13 transversely side-by-side to one another, to generate the composite element. In this case, the diameter of the through-bores 16 shall be slightly larger than the diameter of the blind bores 15, so as to make it possible the end knurled portions 17 to be assembled and locked.

Furthermore, each of said so-formed composite elements is associated with a successive composite element by means of further pin elements 18, e.g., made from pieces of coupling section bar having an approached double circular cross section, or, more simply, an "8"-shaped cross section.

Said further pin elements 18 are inserted inside complementary seats 19, 20 parallelly provided in the nearby of side faces 21, 22 of respectively said unitary end elements 12 and intermediate unitary elements 13, with said free faces 21, 22 being free.

In the example shown in FIGS. 1 and 2, said seats 19, 20 have a cylindrical shape, are open along at least one generatrix, and are opposite longitudinally to the bracelet. In this way, the articulation between a link and the following link is provided.

Some composite elements, usually in the nearby of the bracelet closure elements (not shown in the figures) are constituted in such a way as to enable the bracelet to be adjusted, or varied, in length, so to make is adaptable to the user's wrist. In order to allow such an adaptability, the pin element 14 is replaced by a small-diameter, long screw 23, which can be inserted through an end unitary element 12 provided with a bore portion 24 enlarged and axially lined-up to the blind bore 15, so to render this latter a through-bore.

The end unitary element 12 shall be furthermore provided with a screw-threaded portion 25 suitable for receiving and locking the end of the screw 23. The assemblage of a bracelet according to the invention takes place by simply putting all the unitary elements 12, 13 side-by-side to each other, and associating them with the pin elements 14, 18 and the screws 23, with the composite elements being blocked in position, and the articulated links being formed.

So, e.g., a bracelet can be accomplished, which is provided with a surface shape with hollows staggered in a chequered fashion, with unitary elements with a flat upper surface alternating with one another (not shown) both in the transversal and in the longitudinal direction, and unitary elements with an arched and rounded upper surface (FIGS. 1 and 2), so as to generate a decoration with a varied pattern.

Of course, each of said unitary elements can be provided with a surface finish, a decoration, or portions thereof, so that accomplishing a pattern difficult to be obtained on one single transversal bracelet element, results possible.

Figure 3:
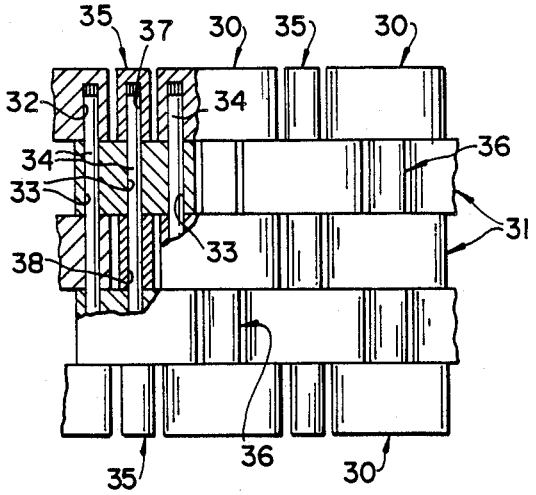
FIG. 3 shows a partially sectional plan view of a further exemplifying practical embodiment of the invention.

FIG. 3 shows a further practical embodiment of the invention shown for exemplifying purposes, wherein each trasversal composite element comprises, alternatively positioned, first unitary elements 30, 31 of larger size, and containing, within three relative bores 32, 33, placed side-by-side and parallel to each other, three pin elements 34 and second unitary elements 35, 36 of a smaller size and containing, inside a relevant single central bore 37, 38 one of said pin elements 34, more precisely the intermediate pin element. As it can be seen, in this case too first and unitary elements 30 and first intermediate unitary elements 31, and second end unitary elements 35 and second intermediate unitary elements 36 with relevant blind bores 32, 37 and through bores 33, 38, are provided. In this way, it is possible to accomplish a transversal composite element, which has a variable-trend shape, wherein, e.g., the larger-size unitary elements are parallelepipedon, and the interposed smaller-size unitary elements are cylindrical, by simply manufacturing two types of unitary elements, which can be obtained with extreme simpleness.

Figure 4:
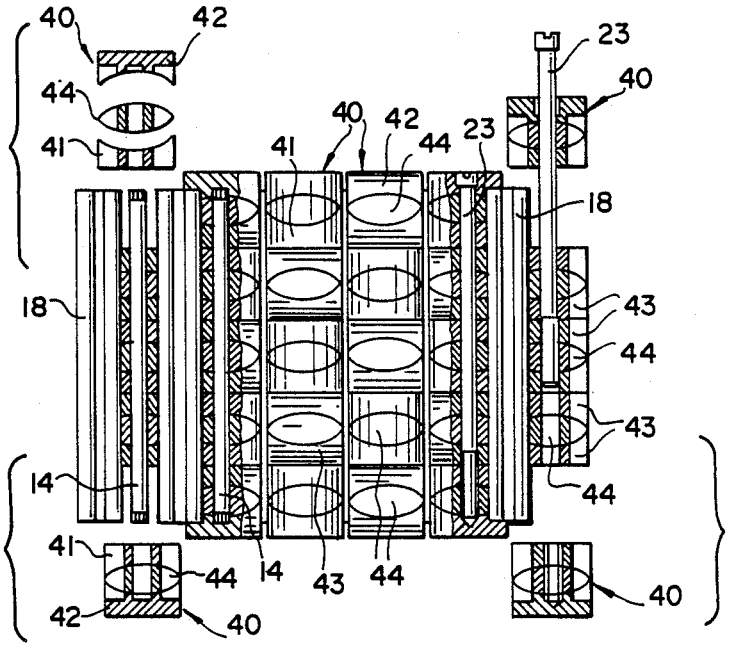
FIG. 4 shows a partially sectional plan view of a third exemplifying practical embodiment of the invention.

FIG. 4 shows a still further exemplifying practical embodiment of the invention, wherein the individual unitary elements 12, 13 of FIGS. 1 and 2, of prismatic shape, result to be composite and formed by smaller unitary elements, having a different shape. In particular, each prismatic element, generally indicated by the reference numeral 40, comprises a couple of side end elements 41, 42, and a couple of intermediate side elements 43, essentially having a "C"-shape, or a rectangular shape with a hollow arched edge, between which a central element 44 having an olive-shape is positioned. Both said side elements 41, 42, 43 and said central, olive-shaped elements 44 have central bores and side seats in the nearby of their side faces, at all similar to those of FIGS. 1 and 2, wherein central pin elements and further side pin elements can be positioned, which are suitable for respectively accomplishing the composite element in the transversal direction, and the articulation between a link and the following link, or between a composite element and the successive composite element.

One can understand how assembling a small number of small elements equal to one another, and easy and cheap to manufacture, results easier than obtaining a bracelet element, or a bracelet link monolythic and having a various-trend outline.

This is particularly, and above all, true, when the material is stainless steel, and cannot be processed by hand.

I claim:

1. An articulated bracelet with a number of composite elements arranged with respect to one another to form a continuous longitudinal chain wherein each composite element represents a link in the chain of the bracelet, each of said composite elements comprising a number of unitary elements, each unitary element having a bore therethrough, the number of unitary elements of each composite element being positioned in side-by-side relationship with one another transversely of the longitudinal chain, each composite element having a first pin element extending transversely through the bores of its respective unitary elements, each of the unitary elements of the composite element having a pair of opposing seats which extend parallel to the bore of the unitary element, and a number of second pin elements having articulation means for interconnecting one composite element with an adjacent composite element whereby each second pin element is positioned within one of the opposed seats of the unitary elements of the one composite element and also positioned within one of the opposed seats of the unitary elements of the adjacent composite element, a number of composite elements being articulately connected to one another to form the links of the chain of the bracelet.

2. The articulated bracelet according to claim 1, wherein said second pin element has portions of a coupling section bar with a double circular cross section in the form of an "8", and each opposed seat is of a cylindrical shape and is open along at least one generatrix.

3. The articulated bracelet according to claim 1, wherein each unitary element bears a surface finishing.

4. The articulated bracelet according to claim 1, wherein said first pin element is a screw having a head.

5. The articulated bracelet according to claim 1, wherein said first pin element has knurled end portions suitable for entering and being locked inside relevant bores of the unitary elements of the composite elements.

6. The articulated bracelet according to claim 1, wherein the unitary elements of each composite element comprises an intermediate unitary element having through bores and seats, and a pair of unitary end elements each having blind bores and seats.

7. The articulated bracelet according to claim 4, wherein at least one of the unitary elements having a through bore in alignment with the bore of said at least one unitary element whereby said through bore houses the head of the screw.

* * * * *